US009532149B2

(12) United States Patent
Elmedyb et al.

(10) Patent No.: US 9,532,149 B2
(45) Date of Patent: Dec. 27, 2016

(54) METHOD OF SIGNAL PROCESSING IN A HEARING AID SYSTEM AND A HEARING AID SYSTEM

(71) Applicant: Widex A/S, Lynge (DK)

(72) Inventors: Thomas Bo Elmedyb, Herlev (DK); Kristian Timm Andersen, Lyngby (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 14/955,639

(22) Filed: Dec. 1, 2015

(65) Prior Publication Data

US 2016/0088407 A1 Mar. 24, 2016

Related U.S. Application Data

(63) Continuation-in-part of application No. PCT/EP2013/062369, filed on Jun. 14, 2013.

(51) Int. Cl.

| | |
|---|---|
| ***H04R 5/00*** | (2006.01) |
| ***H04R 25/00*** | (2006.01) |
| *H04R 1/10* | (2006.01) |

(52) U.S. Cl.

CPC ..... *H04R 25/552* (2013.01); *H04R 25/405* (2013.01); *H04R 1/1083* (2013.01); *H04R 25/554* (2013.01); *H04R 25/558* (2013.01); *H04R 2225/43* (2013.01); *H04R 2460/01* (2013.01)

(58) Field of Classification Search

CPC ... H04R 15/552; H04R 25/405; H04R 25/554; H04R 25/558; H04R 1/1083; H04R 2225/43

See application file for complete search history.

(56) References Cited

U.S. PATENT DOCUMENTS

| | | | | |
|---|---|---|---|---|
| 5,402,496 | A | 3/1995 | Soli et al. | |
| 2001/0028720 | A1* | 10/2001 | Hou | H04R 1/406 381/92 |
| 2001/0036284 | A1* | 11/2001 | Leber | H04R 25/505 381/94.2 |
| 2001/0048740 | A1* | 12/2001 | Zhang | G10L 21/0208 379/406.01 |

(Continued)

FOREIGN PATENT DOCUMENTS

| | | | |
|---|---|---|---|
| WO | 2011/006496 | A1 | 1/2011 |
| WO | 2012/007183 | A1 | 1/2012 |

OTHER PUBLICATIONS

J. B. Allen et al, Multimicrophone Signal-Processing Technique to Remove Room Reverberation from Speech Signals, Journal Acoustical Society America, vol. 62, No. 4, pp. 912-915, Oct. 1977.

Max Kamenetsky et al, A Variable Leaky LMS Adaptive Algorithm, Signals, Systems and Computers, Conference Record of the Thirty-Eighth Asiolmar Conference, vol. 1, pp. 125-128, Nov. 7-10, 2004.

Dong-Yan Huang et al, Maximum a Posteriori Based Adaptive Algorithms, Signals, Systems and Computers, ACSSC 2007 Nov. 4-7, 2007, pp. 1628-1632.

(Continued)

*Primary Examiner* — Simon Sing

(74) *Attorney, Agent, or Firm* — Sughrue Mion, PLLC

(57) ABSTRACT

A method of noise suppression in a hearing aid system by providing an improved noise estimate derived from the difference of a first digital audio signal provided by a first input transducer and an adaptively filtered second digital audio signal provided by a second input transducer. The invention further provides a hearing aid (100, 200) and a hearing aid system (300 and 400) adapted for improving noise suppression in accordance with this method.

15 Claims, 4 Drawing Sheets

(56) References Cited

U.S. PATENT DOCUMENTS

2008/0212811 A1 9/2008 Kates
2008/0212814 A1* 9/2008 Barthel ..... H04R 3/005 381/313
2008/0269926 A1* 10/2008 Xiang ..... H03G 3/32 700/94
2008/0298615 A1* 12/2008 Klinkby ..... H04R 25/453 381/318
2009/0268933 A1 10/2009 Baechler et al.
2011/0144779 A1* 6/2011 Janse ..... G11B 20/10009 700/94
2012/0128163 A1 5/2012 Moerkebjerg et al.
2012/0155666 A1* 6/2012 Nair ..... G10K 11/178 381/71.6
2012/0314885 A1 12/2012 Rasmussen
2012/0328112 A1 12/2012 Jeub et al.
2013/0158989 A1* 6/2013 Song ..... G10L 21/0232 704/226
2014/0301558 A1* 10/2014 Fan ..... G10L 21/0208 381/71.2

OTHER PUBLICATIONS

Oliver Cappe, Elimination of the Musical Noise Phenomenon with the Ephraim and Malah Noise Suppressor, IEEE Transactions on Speech and Audio Processing 2, pp. 345-349, Apr. 1994.

Y. Ephraim et al, Speech Enhancement Using a Minimum Mean-Square Error Log-Spectral Amplitude Estimator, IEEE Transactions on Acoustics, Speech and Signal Processing, vol. ASSP-33, No. 2, Apr. 1985.

Y. Ephraim et al, Speech Enhancement Using a Minimum Mean-Square Error Short-time Spectral Amplitude Estimator, IEEE Transactions on Acoustics, Speech, and Signal Processing, vol. ASSP-32, No. 6 Dec. 1984, pp. 1109-1121.

International Search Report and Written Opinion of the International Searching Authority for PCT/EP2013/062369 dated Aug. 30, 2013.

* cited by examiner

METHOD OF SIGNAL PROCESSING IN A HEARING AID SYSTEM AND A HEARING AID SYSTEM

RELATED APPLICATIONS

The present application is a continuation-in-part of application PCT/EP2013/062369, filed on 14 Jun. 2013, in Europe, and published as WO 2014198332 A1.

BACKGROUND OF THE INVENTION

1. Field of the Invention

The present invention relates to a method of signal processing in a hearing aid system. The invention, more specifically, relates to a method of binaural noise suppression in a hearing aid system. The invention further relates to hearing aids and hearing aid systems having means for noise suppression.

Within the present disclosure a hearing aid system is generally understood as meaning any system which provides an output signal that can be perceived as an acoustic signal by a user, or contributes to providing such an output signal, and which has means which are used to compensate an individual hearing loss of the user or contribute to compensating the hearing loss of the user or contribute to compensating the hearing loss. These systems may comprise hearing aids which can be worn on the body or on the head, in particular on or in the ear, and hearing aids which can be fully or partially implanted. However, devices whose main aim is not to compensate for a hearing loss, for example consumer electronic devices (televisions, hi-fi systems, mobile phones, MP3 players etc.), may also be considered hearing aid systems, provided they have measures for compensating for an individual hearing loss.

Within the present context a hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so-called binaural hearing aid system). Furthermore the hearing aid system may comprise an external device, such as e.g. a smart phone having software applications adapted to interact with other devices of the hearing aid system. Thus within the present context the term "hearing aid system device" may denote a hearing aid or an external device.

In an open space, sound waves propagate generally in straight lines, i.e. directly from point to point. A hard surface may reflect a sound wave. The reflected wave is referred to as an echo. In a space with a hard surface sound propagation from point-to-point may be a combination of a direct wave and an echo. The echo will be delayed due to the longer path, comparing to the direct wave. In a space with multiple hard faces propagation from point-to-point may be by a direct wave and by a multitude of echoes, some of which having bounced many times.

Reverberation is the persistence of sound in a particular space after an original sound has been provided. A reverberation is created when a sound is provided in an enclosed space causing a large number of echoes to build up and then slowly decay as the acoustic energy is absorbed by the walls and air. This is most noticeable when the sound source stops while the reflections continue, decreasing in amplitude, until they can no longer be heard. Reverberation is the aggregate of many thousands of echoes that arrive in very quick succession (0.01-1 milliseconds between echoes). As time passes, the volume of the aggregated echoes decays until the echoes cannot be heard at all.

Often the first say 100 milliseconds of the reverberation is denoted the early reflections, and the remaining part is denoted the late reverberation. It is well known that the early reflections generally may enhance speech intelligibility, while the late reverberation generally is detrimental.

Reverberation is known to have a detrimental effect on speech intelligibility, spatial separation, localization, cognitive load, listening effort and listening comfort. Although moderate amounts of reverberation do not affect speech recognition performance by normal-hearing listeners, it has a detrimental effect on speech intelligibility by hearing impaired and elderly listeners.

Reverberation is particularly a problem in untreated rooms with hard surfaces, where the reflections from the walls interfere with the direct sound, causing both reduced listening comfort and lower speech intelligibility. A few examples of demanding acoustic environments include large public spaces such as indoor train stations, shopping malls and canteens but also smaller rooms such as modern open kitchens. The problem is worsened when there are multiple acoustic sources present, that degrade the target-to-interferer noise ratio.

The detrimental effects of reverberation may, on a general level, be divided into two categories namely overlap-masking and self-masking. Overlap-masking is caused by the overlap of reverberant energy of a preceding phoneme on the following phoneme. This effect is particularly evident for low-energy consonants preceded by high-energy voiced segments (e.g., vowels). The additive reverberant energy fills in the gaps and silent intervals (e.g., stop closures) associated with vocal tract closures. An example of this effect is the words "cab" and "cat" where the high energy vowel masks the low energy consonant which causes consonant confusion which leads to a decrease in intelligibility. Self-masking is caused by the internal smearing of energy within each phoneme. This effect is particularly evident in reverberant sonorant sounds (e.g., vowels), where the format transitions become flattened. Generally, the self-masking effect is substantially smaller compared to the overlap-masking of consonants.

It is well known that people with normal hearing can usually follow a conversation despite being in a situation with several interfering speakers and significant background noise. This situation is known as a cocktail party environment. As opposed hereto hearing impaired people will typically have difficulties following a conversation in such situations. The same is true with respect to hearing in reverberant rooms.

2. The Prior Art

A method for suppression of room reverberation, using the signals recorded by two spatially separated microphones, is disclosed in the article by Allen et al.: "Multimicrophone signal-processing technique to remove room reverberation from speech signals", Journal Acoustical Society America, vol. 62, no. 4, pp. 912-915, October 1977. According to this method the individual microphone signals are transformed into short-term spectra and divided into frequency bands whose corresponding outputs are co-phased (delay differences are compensated), and the gain of each frequency band is set based on the cross correlation of the short-term spectra of the individual microphone signals.

WO-A1-2012007183 discloses a method of processing signals in a hearing aid system comprising the steps of transforming two audio signals to the time-frequency domain, calculating a value representing the interaural coherence, deriving a first gain based on the interaural coherence, applying the first gain value in the amplification of the time-frequency signals, and transforming the signals back into the time domain for further processing in the hearing aid in order to alleviate a hearing deficit of the user of the hearing aid system, and wherein the relation determining the first gain value as a function of the value representing the interaural coherence comprises three contiguous ranges for the values representing the interaural coherence, where the maximum slope in the first and third range are smaller than the maximum slope in the second range and wherein the ranges are defined such that the first range comprises values representing low interaural coherence values, the third range comprises values representing high interaural coherence values and the second range comprises values representing intervening interaural coherence values.

WO-A1-2011006496 discloses a hearing aid system having a processing unit that comprises a first microphone and a second microphone, wherein the output of the first microphone is operationally connected to a first input of a subtraction node and the output of the second microphone is operationally connected to the input of an adaptive filter. The output of the adaptive filter is branched and in a first branch operationally connected to the second input of the subtraction node and in a second branch operationally connected to the input of the remaining signal processing in a hearing aid. The output from the subtraction node is operationally connected to a control input of the adaptive filter.

US-A1-20080212811 discloses a signal processing system with a first signal channel having a first filter and a second signal channel having a second filter for processing first and second channel inputs and producing first and second channel outputs, respectively. Filter coefficients of at least one of the first and second filters are adjusted to minimize the difference between the first and second channel outputs. The resultant signal match processing of the signal processing system gives broader regions of signal suppression than using Wiener filters alone for frequency regions where the interaural correlation is low, and may be more effective in reducing the effects of interference on the desired speech signal. The filtering in the first and second signal channels are carried out in the frequency domain.

US-A1-20120328112 discloses a method for reduction of reverberation in binaural hearing systems. This has been done by developing a method for obtaining a reduced-reverberation, binaural output signal, for a binaural hearing apparatus. First of all, a left input signal and a right input signal are provided. The two input signals are combined to form a reference signal. The reference signal is used to ascertain spectral weights, or these weights are provided in another way, in order to use them to reduce late reverberation. To this end, the two input signals have the spectral weight applied to them. Furthermore, a coherence for signal components of the weighted input signals is ascertained. Non-coherent signal components of both weighted input signals are then attenuated in order to reduce early reverberation.

It is a general problem for the prior art that the methods for binaural suppression of reverberation and noise suffer from sound artifacts. This may impair speech intelligibility and listening comfort for a hearing aid user.

It is therefore an object of the present invention to provide an improved method of processing in a hearing aid that can relieve the detrimental effects of reverberation.

It is another object of the present invention to provide a hearing aid system comprising improved means adapted for relieving the detrimental effects of reverberation.

It is yet another object of the present invention to provide a method and a hearing aid system adapted for improving the listening comfort for a hearing aid user.

It is still another object of the present invention to provide a method and a hearing aid system adapted for improving the suppression of uncorrelated noise in a binaural hearing aid system.

Finally it is another object to provide improved suppression of correlated noise.

SUMMARY OF THE INVENTION

The invention, in a first aspect, provides a method of processing signals in a hearing aid system comprising the steps of: providing a first input signal representing the output from a first input transducer of the hearing aid system; providing a second input signal representing the output from a second input transducer of the hearing aid system; using a time-varying adaptive filter to filter the first input signal, hereby providing a filtered first input signal; subtracting the filtered first input signal from the second input signal to form a difference signal; adapting the time-varying adaptive filter in accordance with a control algorithm; calculating a power estimate of the difference signal hereby providing a noise estimate; providing the noise estimate as input to a noise suppression gain calculator; using the noise suppression gain calculator to provide a time-varying gain adapted for suppressing noise; and applying said time-varying gain to the second input signal.

This provides an improved method for suppression of reverberation in a hearing aid system.

The invention, in a second aspect, provides a hearing aid of a hearing aid system comprising a first acoustical-electrical input transducer adapted to provide a first digital audio signal, an antenna adapted for wireless communication with a second device of the hearing aid system, a time-varying adaptive filter, a filter estimator, a summing unit, a first power spectrum estimator, a noise suppression gain calculator and a noise suppression gain multiplier, wherein—the first digital audio signal is provided to a first input of the summing unit and to the noise suppression gain multiplier, wherein the antenna is adapted to receive a second digital audio signal from the second device of the hearing aid system, wherein the second digital audio signal is provided to the adaptive filter and to the adaptive filter estimator, wherein the time varying adaptive filter is adapted to provide a filtered output signal that is provided to a second input of the summing unit whereby a difference signal is provided by subtracting the filtered output signal from the first digital audio signal, wherein the difference signal is provided to the filter estimator and to the first power spectrum estimator, wherein the first power spectrum estimator is adapted to provide a first power spectrum that can be used as a noise estimate, wherein the noise estimate is provided to the noise suppression gain calculator that is adapted to apply the estimate to provide a frequency dependent time-varying gain, and wherein the noise suppression gain multiplier is adapted to apply the frequency dependent time-varying gain to the first digital audio signal.

The invention, in a third aspect, provides a hearing aid system comprising a hearing aid according to claim 13, wherein said hearing aid system is a binaural hearing aid system and wherein said second device is the contra-lateral hearing aid of the binaural hearing aid system.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
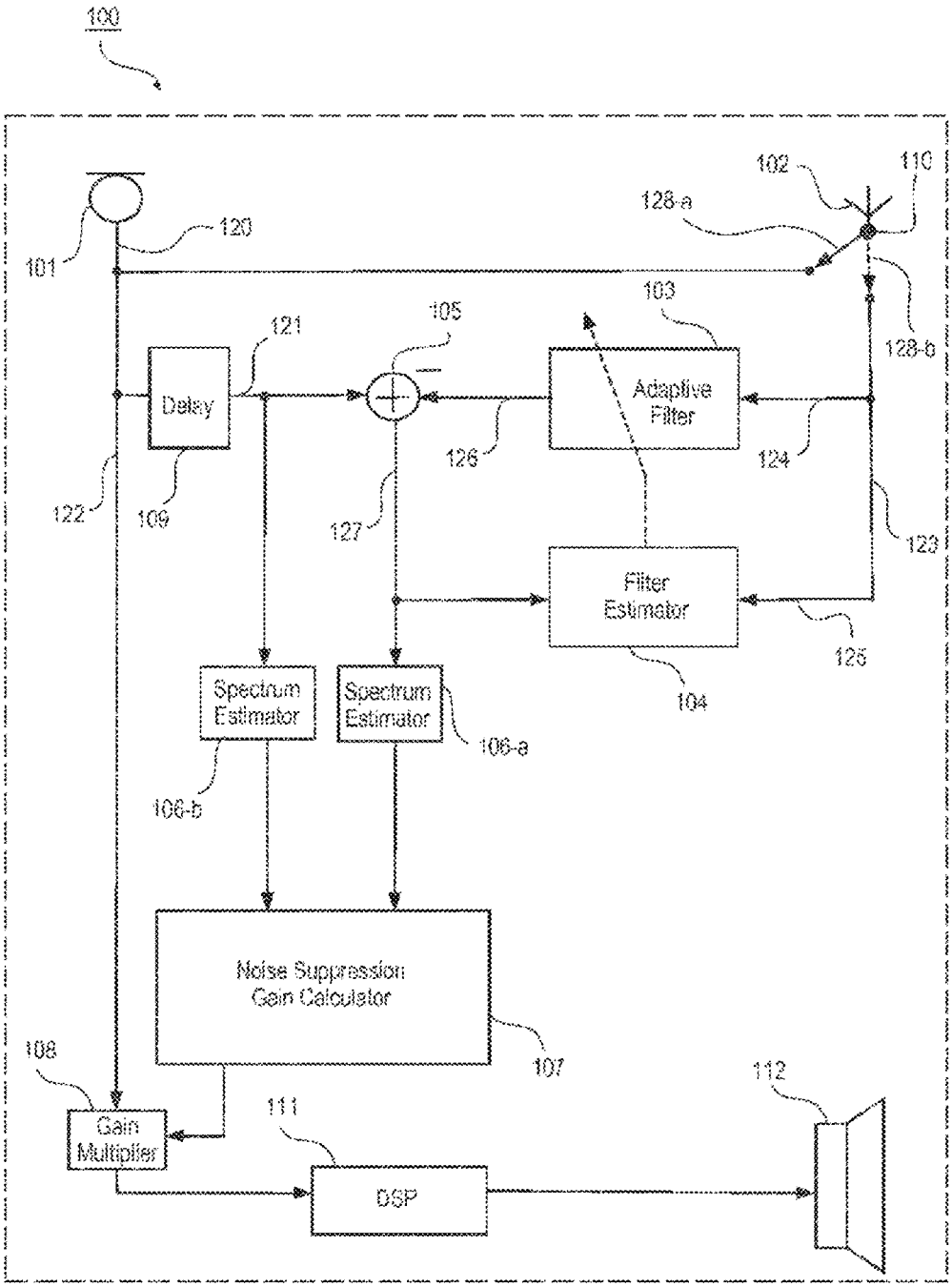
FIG. 1 illustrates highly schematically a hearing aid according to an embodiment of the invention.

The inventors have found that the performance of hearing aid systems with respect to noise suppression and hereby speech intelligibility and listening comfort can be improved by incorporating a noise estimator that uses two acoustical-electrical input signals from two spatially separated input transducers and wherein the noise estimate is derived from a difference signal provided by subtracting an adaptively filtered first input signal from the second input signal whereby a very precise noise estimate can be provided to a subsequent noise suppression gain calculator and gain applicator such that noise suppression is optimized and processing artifacts minimized.

Further the inventors have found that the performance of hearing aid systems can be improved by using a noise estimate derived from a plurality of acoustical-electrical input signals as control input to noise reduction algorithms adapted for processing a single acoustical-electrical input signal, wherein examples of such noise reduction algorithms at least comprise algorithms based on spectral subtraction, Wiener filtering, subspace methods or statistical-model based methods.

Especially, the inventors have found that very efficient suppression of reverberation with a minimum of processing artifacts can be provided by a spectral subtraction noise reduction algorithm using a noise estimate derived from the difference signal of a first acoustical-electrical input signal that has been filtered by a time-varying adaptive filter and a second acoustical-electrical input signal.

Additionally the inventors have found that a noise estimate derived from a signal that has been filtered in a time-varying adaptive filter is very precise whereby a significant reduction in sound artifacts resulting from a wide range of subsequent noise reduction algorithms can be provided, e.g. by minimizing the duration of the smoothing in the noise reduction algorithms. This has proven to be especially significant for suppression of late reverberations.

Further, the inventors have found that a noise estimate derived from a signal that has been filtered in a time-varying adaptive filter can be specifically adapted to a given sound environment because the adaptive filter can be controlled to spatially focus on a target when the target stays in a certain direction by incorporating a-priori knowledge in the control of the time-varying adaptive filter.

Still further the inventors have found that both correlated noise and uncorrelated noise may be suppressed in a simple manner by using the time-varying adaptive filter to provide estimates of both types of noise.

The inventors have also found that by using the time-varying adaptive filter to provide a noise estimate, it is no longer required to limit noise estimation to time periods where no desired sound, such as speech, is detected. Furthermore it is no longer required to freeze the noise estimation during periods where speech is present, whereby more precise noise estimation can be provided even in situations where the noise changes during the periods where speech is present, which in particular may be the case in reverberant locations. Additionally this type of noise estimation does not require means for voice activity detection.

Finally the inventors have found that the invention can provide an estimation of the uncorrelated and correlated noises that depend on the individually considered hearing aid as opposed to noise estimates that are based on the common properties of a set of hearing aids, whereby a more precise estimate is obtained.

Reference is first made to FIG. 1, which illustrates highly schematically a hearing aid 100 that is part of a binaural hearing aid system according to an embodiment of the invention.

The binaural hearing aid system comprises a first hearing aid 100 that is adapted to fit in a first ear of a hearing aid user and a second hearing aid (not shown) adapted to fit in a second ear of the hearing aid user. In the following the first hearing aid 100 may also be denoted the ipse-lateral hearing aid, and the second hearing aid may be denoted the contra-lateral hearing aid.

The hearing aid 100 comprises a first input transducer 101, an inductive antenna 102 adapted for wireless communication with the contra-lateral hearing aid of the binaural hearing aid system, a time-varying adaptive filter 103, a filter estimator 104, a summing unit 105, a first power spectrum estimator 106-*a* and a second power spectrum estimator 106-*b*, a noise suppression gain calculator 107, a noise suppression gain multiplier 108, a delay 109, a switch 110, a digital signal processor 111 adapted to provide an output signal adapted to alleviate a hearing deficit of an individual hearing aid user and an acoustic output transducer 112.

Acoustic sound is picked up by the first input transducer 101. The analog signal from the first input transducer 101 is converted to a first digital audio signal 120 in a first analog-to-digital converter (not shown).

The first digital audio signal 120 is split into three parts. The first part of the first digital audio signal is provided to a delay 109 hereby providing a delayed first digital audio signal 121 which is fed to the first input of the summing unit 105. The second part of the first digital audio signal 122 is provided to the noise suppression gain multiplier 108. The third part of the first digital audio signal is provided to the switch 110, which in a first position 128-*a* feeds the first digital audio signal to the inductive antenna 102 for transmission to the contra-lateral hearing aid, and which in a second position 128-*b* enables reception of a digital audio signal from the contra-lateral hearing aid.

The contra-lateral hearing aid of the binaural hearing aid system is similar to the hearing aid 100 shown in FIG. 1. It is adapted to transmit a first contra-lateral digital audio signal 123 from the contra-lateral hearing aid (not shown) of the binaural hearing aid system and to the inductive antenna 102 of the hearing aid 100.

The first contra-lateral digital audio signal 123 is provided in the contra-lateral hearing aid in a manner analogous to how the first digital audio signal is provided in the first hearing aid 100, i.e. acoustic sound is picked up by an input transducer and the analog signal from said input transducer is, using an analog-to-digital converter, converted to a signal, which will be wirelessly transmitted from an inductive antenna 102 in the contra-lateral hearing aid and to the first (i.e. ipse-lateral) hearing aid 100, where it will be designated the first contra-lateral digital audio signal 123.

The first contra-lateral digital audio signal 123 is split into two among which the first part of the first contra-lateral digital audio signal 124 is provided to the adaptive filter 103, while the second part of the first contra-lateral digital audio signal 125 is provided to the adaptive filter estimator 104.

The time varying adaptive filter 103 provides a filtered output signal 126 that is provided to a second (subtraction) input of the summing unit 105, whereby a difference signal 127 is provided by subtracting the filtered output signal 126 from the first part of the delayed first digital audio signal 121. The difference signal 127 is split in two and provided both to the filter estimator 104 and to the first power spectrum estimator 106-*a*.

The time delay 109 is applied to the first digital audio signal 120 in order to compensate for the relative delay of the contra-lateral digital audio signal 123 due to the time lag by the wireless transmission between the ipse-lateral and contra-lateral hearing aids of the binaural hearing aid system and due to the possible sound propagation time delay of the contra-lateral digital audio signal 123 in case sound reaches the ipse-lateral hearing aid before the contra-lateral hearing aid. In order to, on the other hand, allow prediction of sound that reaches the contra-lateral hearing aid before the ipse-lateral hearing aid then the length of the time window of the adaptive filter is set to be twice the wireless transmission delay plus the maximum sound propagation time delay.

However, in variations any delay that allows at least most correlated sounds to be predicted by the adaptive filter may be applied.

According to a variation of the FIG. 1 embodiment the magnitude of the time delay provided by the time delay 109 in the first hearing aid can be selected or automatically adjusted based on a measurement of the time delay between the first digital audio signal 120 and the first contra-lateral digital audio signal 123, since this delay may vary dependent on whether the first contra-lateral digital audio signal 123 emerges from a contra-lateral hearing aid or an auxiliary device and dependent on the distance between the first hearing aid 100 and the auxiliary device.

The first part of the delayed first digital audio signal 121 is split in two such that in addition to be provided to a first input of the summing means 105 the first part of the delayed first digital audio signal 121 is also provided to the second power spectrum estimator 106-*b*.

Hereby the first power spectrum estimator 106-*a* provides a first power spectrum that can be used as a noise estimate, and the second power spectrum estimator 106-*b* provides a second power spectrum that can be used as a signal-plus-noise estimate. The noise estimate and the signal-plus-noise estimate are provided to the noise suppression gain calculator 107 that applies the estimates to provide a frequency dependent time-varying gain that is applied to the second part of the first digital audio signal 122 using the gain multiplier 108.

Thus in the following the terms power spectrum noise estimate may be used interchangeably. However, in variations the noise estimates need not be provided as power spectra.

The first power spectrum estimator 106-*a* provides a power spectrum that can be used as a noise estimate because the inventors have found that the difference signal 127 comprises a significant part of any reverberant tail.

The second power spectrum estimator 106-*b* provides a power spectrum that can be used as a signal-plus-noise estimate because the first digital audio signal 120 comprises both the desired signal and the noise.

According to the FIG. 1 embodiment the power spectra provided by the power spectrum estimators 106-*a* and 106-*b* are calculated by using a first filter bank (not shown) to split the delayed first digital audio signal 121 into a first number of frequency bands and a second filter bank (not shown) to split the difference signal 127 into a second number of frequency bands.

The signal power in each frequency band is estimated using a Hilbert transformation whereby a precise signal power estimate can be provided, based on a smoothing of a short time duration, because the Hilbert transformation provides both the real and imaginary signal parts and the real signal part can be used directly as the signal power estimate requiring either no or only little further smoothing of the signal power estimate.

It is a specific advantage of the present invention that precise noise estimates can be provided without requiring long smoothing times. This is primarily a consequence of using the time-varying adaptive filter 103 to provide one input to the summing unit 105 forming the difference signal 127, but the effect becomes even more pronounced when combined with a power estimation based on the use of Hilbert transforms. However, a Hilbert transformation need not be used.

A great number of methods for providing a power estimate are readily available for a person skilled in the art.

According to the FIG. 1 embodiment a smoothing time of only 20 milliseconds of the power estimate derived based on the Hilbert transformation has proven sufficient, and in variations the smoothing time may be in the range between 1 and 50 milliseconds. It has turned out that the speed and precision of the noise estimate according to the invention has a surprisingly pronounced and significant impact with respect to the beneficial reduction of processing artifacts caused by a subsequent noise reduction algorithm that applies the noise estimate as input.

It has been found that these beneficial effects are especially pronounced when the user of the binaural hearing aid system is in a reverberant room.

According to a variation of the FIG. 1 embodiment the power spectra provided by the power spectrum estimators 106-*a* and 106-*b* employ a Fourier transform to transform the time-varying difference signal 127 and the delayed first digital audio signal 121 into the frequency domain and use an instantaneous value or a time-average or a low-pass filtering of the frequency bins to provide the power spectra.

Thus, a key aspect of the present invention is the use of a time-varying adaptive filter to provide a noise estimate for use in a subsequent noise reduction algorithm, and basically any known method for providing a power spectrum of a signal derived from an output of the time-varying adaptive filter 103 can be used. I.e. a frequency filter bank or a Fourier transformation may be used to provide the spectra. A power spectrum can be provided without requiring a transformation into the frequency domain by using a filter bank. On the other hand it is noted that by using a Fourier transformation to provide the spectra a higher frequency resolution can be provided which is generally considered advantageous. In variations other methods for providing high-resolution frequency spectra can be used, all of which will be well known for a person skilled in the art.

The inventors have surprisingly found that the advantage achieved with respect to reducing processing artifacts, caused by a subsequent noise reduction algorithm, persists even when a time-domain signal, derived from the time-varying adaptive filter 103, such as the difference signal 127, is subsequently transformed into the frequency domain in order to provide a power spectrum.

According to the known art of noise reduction algorithms for binaural hearing aid systems the noise estimation typically includes a determination of whether or not speech is present. This may be done by evaluating certain statistical signal characteristics, such as e.g. percentiles, or in some other way. A huge variety of advanced noise estimation algorithms exist, but most of them still suffer from the fact that the noise is only estimated during periods without speech and consequently are not well suited to estimate noise that changes during periods with speech. Therefore it should be appreciated, that it is a specific advantage of the noise estimation algorithm provided by the present invention, that the noise estimation is independent on whether speech is present.

The output from the noise suppression gain multiplier 108 is provided to the remaining parts of the hearing aid system i.e. the digital signal processor 111 and the output transducer 112. According to the present embodiment the remaining parts of the hearing aid system comprises amplification means adapted to alleviate a hearing impairment. In variations the remaining parts may also comprise additional noise reduction means.

In further variations of the embodiment of FIG. 1 the gain multiplier can be positioned anywhere in the primary signal path of the hearing aid system, wherein the primary signal path comprises an acoustical-electrical input transducer, amplification means adapted to alleviate a hearing impairment and an electrical-acoustical output transducer. Normally the primary signal path will also comprise means for noise reduction of the input signal provided by the acoustical-electrical input transducer and analog-to-digital and digital-to-analog converters. Thus the gain applied by the noise suppression gain multiplier 108 may be applied to the primary signal path before or after said amplification means adapted to alleviate a hearing impairment.

According to the embodiment of FIG. 1 the first digital audio signal 120 is provided by the first input transducer 101 and the first contra-lateral digital audio signal 123 is provided from the contra-lateral hearing aid of the binaural hearing aid system.

However, in variations the first contra-lateral digital audio signal 123 can be replaced by a second digital audio signal from a second input transducer accommodated in the same hearing aid as the first input transducer. For the suppression of e.g. turbulent wind noise the spatial separation of the input transducers need not be larger than a few centimeters in order to provide that the wind noise provided by turbulent airflow around the input transducers is uncorrelated, whereby a noise estimate according to the invention becomes appropriate for the purpose of estimating wind noise provided by turbulent airflow or for the purpose of estimating microphone noise.

According to another variation the first contra-lateral digital audio signal 123 can be replaced by a third digital audio signal from a third input transducer accommodated in an auxiliary device of the hearing aid system, such as a remote control, or in an external device, such as a smart phone. For the suppression of especially late reverberations, the performance will improve with increasing spatial separation of the input transducers because the correlation of the late reverberations decreases with increasing spatial separation of the input transducers. Therefore it can be advantageous to have a third input transducer accommodated in an auxiliary device of the hearing aid system, or in an external device, because these devices can be positioned relatively far from the hearing aids, i.e. by giving the device to another person or by positioning the device on a table. In the following an external device, e.g. a smart phone may be considered an auxiliary device of the hearing aid system, provided the external device is adapted to interact with the hearing aid system.

In yet other variations either or both of the first digital audio signal 120 and the first contra-lateral digital audio signal 123 are provided by a directional system that combines at least two independent input transducer signals using methods that are well known within the art of hearing aids.

According to the embodiment of FIG. 1 the time-varying adaptive filter 103 is of the FIR type. In variations the filter could also be of the IIR type or basically any other filter type. It is a specific advantage of the FIG. 1 embodiment that the time-varying adaptive filter provides a very processing efficient method of estimating the correlated signal part between two transducer signals as opposed to methods that are based on frequency transformations or involve calculation of measures such as e.g. the coherence, that may be well defined but do not necessarily contribute to improving the noise suppression in a manner that justifies the required processing power.

According to the embodiment of FIG. 1 the time-varying adaptive filter 103 comprises 100 taps and is sampled with a speed of 32 kHz, which corresponds to a time window of only 3 milliseconds. However, this short time window is sufficient to allow the non-reverberant or early reverberation signal parts of the first contra-lateral digital audio signal 123 to be predicted, whereas the major part of the remaining and late reverberant signal parts can not be predicted. The power spectrum of the difference signal 127 is therefore a very good estimate of a noise power spectrum directed at reducing especially late reverberation.

According to a variation of the FIG. 1 embodiment the first digital audio signal 120 and the first contra-lateral digital audio signal 123 are split into a number of frequency bands using a filter bank. This variation requires an additional time-varying adaptive filter, a filter estimation means and a summing unit for each of the frequency bands, but may on the other hand provide even more precise noise and signal-plus-noise estimates.

According to the FIG. 1 embodiment the filter estimation means 104 controls the time-varying adaptive filter 103 based on the difference signal 127 and the second part of the first contra-lateral digital audio signal 125. The operation of the filter estimation means is based on the "variable leaky LMS adaptive algorithm". This algorithm was first disclosed in the paper "A variable leaky LMS adaptive algorithm" by Kamenetsky and Widrow, in Signals, Systems and Computers, Conference Record of the Thirty-Eighth Asilomar Conference, vol. 1, pp. 125-128, 7-10 Nov. 2004.

The inventors have found that by carefully selecting the values of the step size parameter μ and the time-varying parameter $\gamma_k$, and by updating the vector comprising the adaptive filter weights $w_k$, where k is the time index, in accordance with equation (7) of the paper by Kamenetsky and Widrow then the difference signal 127 can be used to make a noise estimate that when used as input to a standard noise reduction algorithm can provide very efficient suppression of reverberation with a minimum of signal processing artifacts. The paper by Kamenetsky and Widrow discloses an error signal that is derived as the difference between a desired output and the output from an adaptive filter. Thus according to the embodiment of FIG. 1, the difference signal 127 represents an error signal $\epsilon_k$, the delayed first digital audio signal 121 represents a desired signal, the filtered output signal 126 is the filter output and the first contra-lateral digital audio signal 123 represents the input signal vector $x_k$. The equation is given by:

$$w_{(k+1)}=(1-2\mu\gamma_k)w_k+2\mu\epsilon_k x_k$$

According to the present embodiment, the difference signal 127 is applied as the error signal, and the first part of the contra-lateral digital audio signal 124 is used as the input signal. The second part of the first contra-lateral digital audio signal 125 is used for normalization whereby the stability of the adaptive algorithm can be improved in ways that are obvious for a person skilled in the art.

According to a specific variation of the FIG. 1 embodiment a-priori knowledge about the adaptive filter is incorporated in the adaptive algorithm. The inventors have found that by controlling the time-varying adaptive filter 103 using these so called Maximum-a-posteriori adaptive algorithms that are based on a maximum a-posteriori optimization formulation then the speed and precision of the noise estimate can be improved even further.

Further details concerning this type of adaptive algorithms can be found e.g. in the paper by Huang, Huang and Rahardja: "Maximum a Posteriori based adaptive algorithms" published in: Signals, Systems and Computers, ACSSC 2007, 4-7 Nov. 2007, pp. 1628-1632.

In yet other variations of the FIG. 1 embodiment basically any adaptive algorithm, such as e.g. LMS or NLMS algorithms, may be used and may be implemented in ways that will be obvious for a person skilled in the art.

According to the embodiment of FIG. 1 the noise suppression gain calculator 107 uses the signal-plus-noise estimate provided by the second power spectrum estimator 106-*b* and the noise estimate provided by the first power spectrum estimator 106-*a* to calculate a gain adapted to suppress noise and hereby improve listening comfort and speech intelligibility for the hearing aid system user. The inventors have found that a noise reduction algorithm, based on an input signal from only a single input transducer, may provide surprisingly good performance when using the signal-plus-noise estimate and noise estimate provided according to the FIG. 1 embodiment.

Especially the inventors have found that the performance of a noise suppression algorithm, based on short-time-spectral-attenuation disclosed in the paper by Ephraim and Malah: "Speech enhancement using a minimum mean-square error short-time spectral amplitude estimator", IEEE Transactions on acoustics, speech and signal processing, vol. ASSP-32, no. 6, December 1984, may be improved by selecting a value of only 0.5 for a weighting parameter α when the noise and signal-plus-noise estimates according to the invention are used.

Using the notation of the paper by Cappe: "Elimination of the musical noise phenomenon with the Ephraim and Malah noise suppressor" IEEE Transactions on Speech and Audio Processing 2 (2), pp. 345-349, April 1994, the algorithm disclosed in said paper by Ephraim and Malah provides a spectral gain $G(p, w_k)$ that can be expressed as:

$$G(p, w_k) = \frac{\sqrt{\pi}}{2}\sqrt{\left(\frac{1}{1+R_{post}}\right)\left(\frac{R_{prio}}{1+R_{prio}}\right)} \times M\left[(1+R_{post})\left(\frac{R_{prio}}{1+R_{prio}}\right)\right]$$

wherein M is a hypergeometric function, wherein the spectral gain $G(p, w_k)$ is applied to each short term spectrum value $X(p,w_k)$ of the input signal and wherein p and $w_k$ are the time and frequency indices respectively. Further details concerning the function M can be found in the paper by Ephraim and Malah, see equations (7)-(10) therein.

The a priori signal-to-noise-ratio $R_{prior}$ may be determined as:

$$R_{prior}(p, w_k) = (1-\alpha)P[R_{post}(p, w_k)] + \alpha\frac{|G(p-1, w_k)X(p-1, w_k)|^2}{v(w_k)}$$

wherein $v(w_k)$ is the noise estimate, P[x]=x if x>0 and P[x]=0 otherwise and α is the weighting parameter already discussed above.

According to variations of the present invention the weighting parameter α may be set to a value selected from within the range between 0.2 and 0.7, preferably between 0.4 and 0.6 whereby the processing artifacts may be significantly reduced. It is noted that these values are much lower than the value of 0.98 that is suggested in the paper by Cappe.

The a posteriori signal-to-noise ratio may be determined as:

$$R_{post}(p, w_k) = \frac{|X(p, w_k)|^2}{v(w_k)} - 1$$

According to the present invention the short term spectrum value is determined by the power spectrum estimator 106-*b* based on the first part of the delayed first digital audio signal 121 and the spectral gain is applied to the second part of the first digital audio signal 122 hereby providing a noise reduced first digital audio signal. The spectral gain is applied to the second part of the first digital audio signal 122 after it has been split into a number of frequency bands using a filter bank or after it has been transformed into the frequency domain using e.g. a Fast Fourier transformation. In yet another variation the spectral gain is applied through a shaping filter that incorporates the spectral gain. In the present context a shaping filter is to be understood as a time-varying filter with a single broadband input and a single broadband output. Such shaping filters are well known within the art of hearing aids, see e.g. chapter 8 especially page 244-255 of the book "Digital hearing aids" by James M. Kates, ISBN 978-1-59756-317-8.

According to the embodiment of FIG. 1 the noise reduced first digital audio signal is transformed back to the time domain before being provided for further processing in the hearing aid. However, according to variations the noise reduced first digital audio signal is not transformed back to the time domain.

Generally the many noise suppression algorithms based on short term spectra are faced with the challenge that it may be difficult to provide that the speech intelligibility improvements achieved through the noise suppression exceed the speech intelligibility impairments due to the speech artifacts that result from the processing of the short term spectra.

The inventors have found that superior performance of especially the algorithm disclosed by Ephraim and Malah can be achieved by using a noise estimate derived from the difference signal 127 according to the embodiment of FIG. 1, which is based on the signals from two spatially separated acoustical-electrical input transducers, such as microphones, as opposed to deriving the noise estimate from only a single acoustical-electrical input transducer.

However, according to variations of the present invention, basically any noise suppression algorithm can be used e.g. algorithms based on Wiener Filtering, Statistical-Model-Based Methods and Subspace methods.

A person skilled in the art will have no problem implementing these alternative noise suppression algorithms in accordance with the invention, and further background information for these alternative noise suppression algorithms can be found e.g. in the book by Plilipos C. Loizou: "Speech Enhancement: Theory and Practice", CRC Press, 2007, ISB: 978-0-8493-5032-0.

Figure 2:
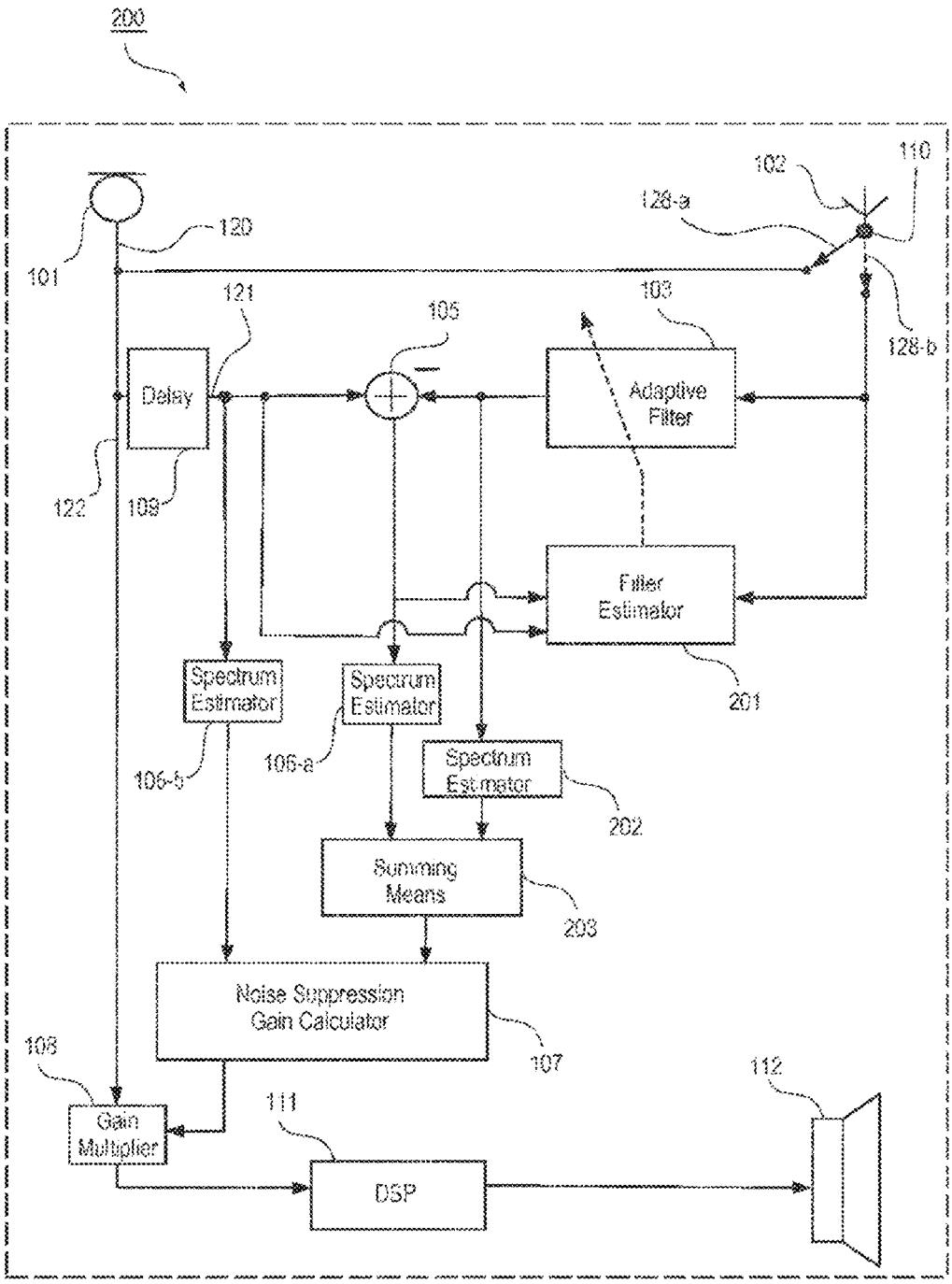
FIG. 2 illustrates highly schematically a hearing aid according to a second embodiment of the invention.

Reference is now made to FIG. 2, which shows schematically a hearing aid 200 similar to that in FIG. 1 except in that the filtered output signal 126 is split into two and consequently provided both to the summing unit 105 and to the third power spectrum estimator 202 that functions in the same way as the power spectrum estimators 106-*a* and 106-*b* with the added feature that the estimation is only carried out when speech is not detected in the filtered output signal 126. The detection of speech can be carried out in a variety of ways all of which will be well known for a person skilled in the art. Therefore the third power spectrum estimator 202 provides an estimate of the correlated noise as opposed to the estimate of the uncorrelated noise provided by second power spectrum estimator 106-*a*. These two noise estimates are input to summing means 203 that adds the levels of the two noise estimates hereby providing an even more precise noise estimate that can be used as input to the noise suppression gain calculator 107.

In variations of the FIG. 2 embodiment the correlated noise can be estimated without requiring detection of speech, e.g. by using the 10% percentile of the filtered output signal as input to the third power spectrum estimator 202.

Further the FIG. 2 embodiment differs from the FIG. 1 embodiment in that the delayed first digital audio signal 121 is also used as input to the filter estimator 201 whereby the control of the time-varying adaptive filter can be improved in ways that will be obvious for a person skilled in the art.

In variations of the FIG. 2 embodiment the estimation of the correlated noise or the additional input to filter estimator 201 can be omitted.

Figure 3:
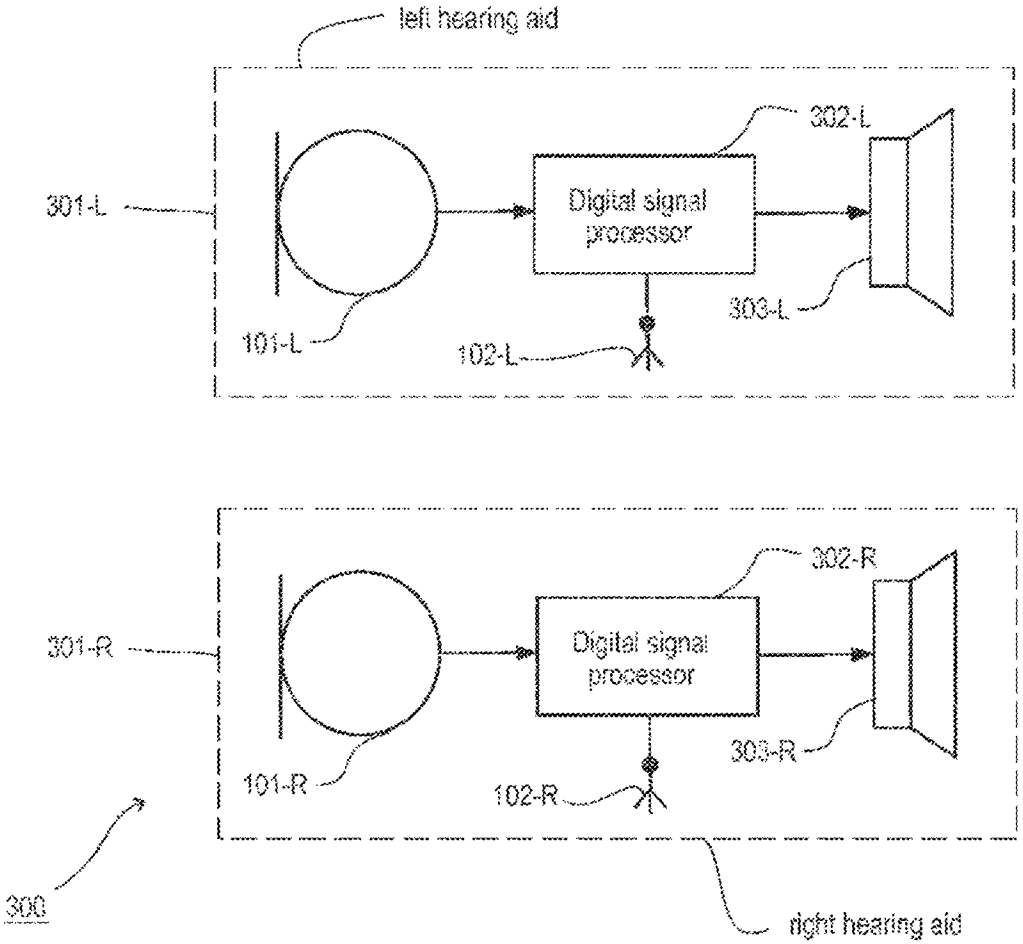
FIG. 3 illustrates highly schematically a binaural hearing aid system according to an embodiment of the invention.

Reference is now made to FIG. 3, which highly schematically illustrates a binaural hearing aid system 300 according to an embodiment of the invention.

The binaural hearing aid system 300 comprises a left hearing aid 301-L and a right hearing aid 301-R. Each of the hearing aids comprises at least one acoustical-electrical input transducer (typically a microphone) 101-L and 101-R, a digital signal processor 302-L and 302-R that comprises all the electronic components disclosed in the embodiments of FIG. 1, an inductive antenna 102-L and 102-R and an electrical-acoustical output transducer 303-L and 303-R.

In a variation of the embodiment of FIG. 3 each of the digital signal processors 302-L and 302-R comprises all the electronic components disclosed in the embodiment of FIG. 2.

Figure 4:
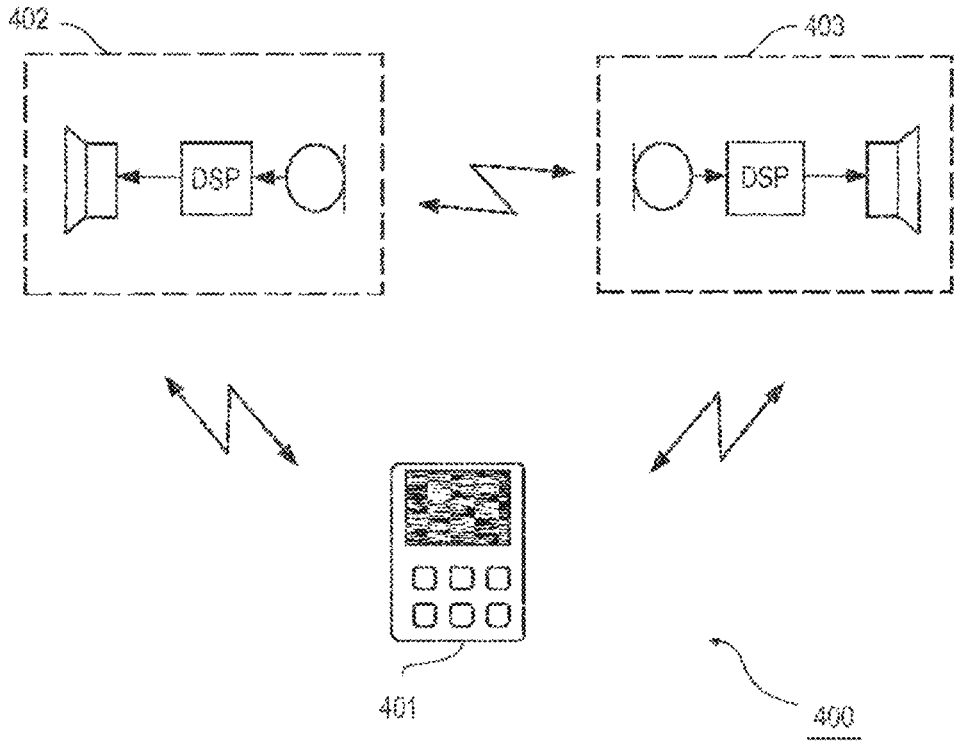
FIG. 4 illustrates highly schematically a binaural hearing aid system, comprising an external device, according to an embodiment of the invention.

Reference is now made to FIG. 4, which illustrates highly schematically a binaural hearing aid system 400 according to an embodiment of the invention. The binaural hearing aid system 400 comprises an auxiliary device 401, a first hearing aid 402 and a second hearing aid 403. The hearing aids 402 and 403 of the FIG. 4 embodiment are similar to those disclosed in the FIG. 1 embodiment or in the FIG. 2 embodiment except in that one of the hearing aids is adapted to selectively receive the contra-lateral signal 123 from the external device 401. Thus the hearing aid user may selectively determine whether to receive the contra-lateral signal 123 from the external device 401 or from contra-lateral hearing aid.

In a further variation of the FIG. 4 embodiment the hearing aid system 400 needs not be a binaural hearing aid system.

In variations of all the disclosed embodiments the inductive antenna 102, 102-L and 102-R need not be inductive but can instead be a far-field radio antenna adapted for operating at 2.4 GHz. However, basically any suitable operating frequency can be used, all of which will be readily known by a person skilled in the art.

Other modifications and variations of the structures and procedures will be evident to those skilled in the art.

We claim:

1. A method of processing signals in a hearing aid system comprising the steps of:

providing a first input signal representing the output from a first input transducer of the hearing aid system;

providing a second input signal representing the output from a second input transducer of the hearing aid system;

using a time-varying adaptive filter to filter the first input signal, hereby providing a filtered first input signal;

subtracting the filtered first input signal from the second input signal to form a difference signal;

adapting the time-varying adaptive filter in accordance with a control algorithm;

calculating a power estimate of the difference signal hereby providing a noise estimate;

providing the noise estimate as input to a noise suppression gain calculator;

using the noise suppression gain calculator to provide a time-varying gain adapted for suppressing noise; and applying said time-varying gain to the second input signal.

2. The method according to claim 1, comprising the further step of:

providing that the first input transducer and the second input transducer are accommodated in a first hearing aid of the binaural hearing aid system.

3. The method according to claim 1, comprising the further step of:

providing that the first input transducer is accommodated in a first hearing aid of the hearing aid system and that the second input transducer is accommodated in a second hearing aid of the binaural hearing aid system.

4. The method according to claim 1, comprising the further step of:

providing that the first input transducer is accommodated in a first hearing aid of the hearing aid system and that the second input transducer is accommodated in an auxiliary device of the hearing aid system.

5. The method according to claim 1, wherein a smoothing time of less than 30 milliseconds is used to provide the noise estimate.

6. The method according to claim 1, wherein said step of calculating a power estimate of the difference signal comprises a step of:

estimating a power spectrum of the difference signal hereby providing an estimate of the noise power spectrum.

7. The method according to claim 1, comprising the further steps of:

calculating a power estimate of the second input signal hereby providing a signal-plus-noise estimate;

estimating a power spectrum of the second input signal, hereby providing an estimate of the signal-plus-noise power spectrum; and providing the estimate of the signal-plus-noise power spectrum as input to the noise suppression gain calculator.

8. The method according to claim 1, wherein the step of applying said time-varying gain to the second input signal comprises the steps of:

transforming said second input signal into the frequency domain;

applying a time-varying spectral gain hereby providing a noise reduced second input signal; and transforming said noise reduced second input signal back to the time domain.

9. The method according to claim 1, wherein said step of adapting the time-varying adaptive filter in accordance with a control algorithm comprises a step of:

adapting the time-varying adaptive filter to minimize the level of the difference signal.

10. The method according to claim 1, wherein said step of adapting the time-varying adaptive filter in accordance with a control algorithm comprises a step of:

adapting the time-varying adaptive filter based on a maximum a-posteriori optimization formulation.

11. The method according to claim 1, wherein said step of adapting the time-varying adaptive filter in accordance with a control algorithm comprises a step of:

using as input to the control algorithm at least the first input signal, the second input signal and the difference signal.

12. The method according to claim 1, comprising the further step of applying a time delay to the second input signal, and subsequently subtracting the delayed second input signal from the filtered first input signal in order to provide the difference signal.

13. A hearing aid of a hearing aid system comprising:

a first acoustical-electrical input transducer adapted to provide a first digital audio signal, an antenna adapted for wireless communication with a second device of the hearing aid system, a time-varying adaptive filter, a filter estimator, a summing unit, a first power spectrum estimator, a noise suppression gain calculator and a noise suppression gain multiplier, wherein the first digital audio signal is provided to a first input of the summing unit and to the noise suppression gain multiplier, wherein the antenna is adapted to receive a second digital audio signal from the second device of the hearing aid system, wherein the second digital audio signal is provided to the adaptive filter and to the adaptive filter estimator, wherein the time varying adaptive filter is adapted to provide a filtered output signal that is provided to a second input of the summing unit whereby a difference signal is provided by subtracting the filtered output signal from the first digital audio signal, wherein the difference signal is provided to the filter estimator and to the first power spectrum estimator, wherein the first power spectrum estimator is adapted to provide a first power spectrum that can be used as a noise estimate, wherein the noise estimate is provided to the noise suppression gain calculator that is adapted to apply the estimate to provide a frequency dependent time-varying gain, and wherein the noise suppression gain multiplier is adapted to apply the frequency dependent time-varying gain to the first digital audio signal.

14. A hearing aid system comprising a hearing aid according to claim 13, wherein said hearing aid system is a binaural hearing aid system and wherein said second device is the contra-lateral hearing aid of the binaural hearing aid system.

15. The hearing aid system according to claim 14, wherein said second device selectively is an auxiliary device selected from a group of devices comprising a hearing aid remote control and a smart phone.

* * * * *